US011828162B2

(12) United States Patent
Zhang et al.

(10) Patent No.: US 11,828,162 B2
(45) Date of Patent: Nov. 28, 2023

(54) ARRANGEMENT DEVICE FOR INTEGRATED SENSORS AT DEEP POSITION OF SLIDING MASS AND MONITORING METHOD

(71) Applicant: CHINA UNIVERSITY OF GEOSCIENCES (WUHAN), Wuhan (CN)

(72) Inventors: Junrong Zhang, Wuhan (CN); Huiming Tang, Wuhan (CN); Yongquan Zhang, Wuhan (CN); Changdong Li, Wuhan (CN); Chengyuan Lin, Wuhan (CN); Qinwen Tan, Wuhan (CN); Shu Zhang, Wuhan (CN); Xuexue Su, Wuhan (CN)

(73) Assignee: CHINA UNIVERSITY OF GEOSCIENCES (WUHAN), Wuhan (CN)

( * ) Notice: Subject to any disclaimer, the term of this patent is extended or adjusted under 35 U.S.C. 154(b) by 188 days.

(21) Appl. No.: 17/401,329

(22) Filed: Aug. 13, 2021

(65) Prior Publication Data

US 2022/0412206 A1 Dec. 29, 2022

Related U.S. Application Data

(63) Continuation of application No. PCT/CN2021/107486, filed on Jul. 21, 2021.

(30) Foreign Application Priority Data

Jun. 23, 2021 (CN) ..... 202110699213.8

(51) Int. Cl.
*E21B 47/01* (2012.01)
*E21B 47/092* (2012.01)
*E21B 23/14* (2006.01)

(52) U.S. Cl.
CPC ..... *E21B 47/01* (2013.01); *E21B 23/14* (2013.01); *E21B 47/092* (2020.05)

(58) Field of Classification Search
CPC ..... E21B 47/01; E21B 47/092; E21B 49/06; E21B 49/10; E21B 23/14
See application file for complete search history.

(56) References Cited

U.S. PATENT DOCUMENTS 3,183,600 A * 5/1965 Jay ..... E21B 47/08 33/544.2
8,113,280 B2 * 2/2012 Sherrill ..... E21B 47/01 166/264

(Continued)

*Primary Examiner* — Christopher J Sebesta
(74) *Attorney, Agent, or Firm* — True Shepherd LLC; Andrew C. Cheng

(57) ABSTRACT

A casing pipe extends in a vertical direction and is configured to be lowered into a borehole, and a mounting hole penetrates a side wall of the casing pipe; a push body is mounted in the mounting hole, a push groove is provided in one side, facing an interior of the casing pipe, of the push body, a flexible body is attached to an inner side wall of the casing pipe, one end of the flexible body is connected to the push body, the other end thereof is located in the casing pipe, and a sensor is mounted on the flexible body; and a propelling portion is connected to a driving mechanism and configured to be lowered to a position, opposite the push groove, in the borehole, and the driving mechanism drives the propelling portion to move towards the push groove.

9 Claims, 9 Drawing Sheets

(56) References Cited

U.S. PATENT DOCUMENTS

| | | | | |
|---|---|---|---|---|
| 8,323,219 | B2 | 12/2012 | Cochran | |
| 10,682,076 | B2 | 6/2020 | Larson et al. | |
| 10,888,251 | B2 | 1/2021 | Larson et al. | |
| 2009/0133932 | A1* | 5/2009 | Church | E21B 49/06 175/44 |

* cited by examiner

ARRANGEMENT DEVICE FOR INTEGRATED SENSORS AT DEEP POSITION OF SLIDING MASS AND MONITORING METHOD

CROSS-REFERENCE TO RELATED APPLICATIONS

This application is a continuation of International Patent Application No. PCT/CN2021/107486 with a filing date of Jul. 21, 2021, designating the United States, now pending, and further claims priority to Chinese Patent Application No. 202110699213.8 with a filing date of Jun. 23, 2021. The content of the aforementioned applications, including any intervening amendments thereto, are incorporated herein by reference.

TECHNICAL FIELD

The present disclosure relates to the technical field of geological disaster monitoring and prevention, and particularly relates to an arrangement device for integrated sensors at a deep position of a sliding mass and a monitoring method.

BACKGROUND

As a highly dangerous natural disaster, the landslide disaster has a high occurrence frequency, a wide damage range and serious harm, causing a large number of casualties and huge economic losses every year. An important measure for dealing with the landslide disaster is to develop the landslide monitoring apparatus, so as to achieve the landslide prediction and early warning, and then to reduce the loss caused by landslide to the minimum.

Landslide monitoring substantially relies on capture of geological parameter information, including surface deformation, surface runoff, seepage, ground cracks, etc., of the surface of the sliding mass for a long time. Except for deep deformation and seepage, monitoring of the other geological parameter information at the deep position of the sliding mass is limited due to lack of monitoring instruments, and coupling between monitoring data is low. The deformation destruction of landslide is evolved dynamically and spatiotemporally, with the evolution stages closely correlated with the evolution models, and multi-field coupling feature is found. Since the "multi-measurement in one hole" technology is introduced, it has drawn increasing attention from engineering geologists in recent years. Integrated sensors are arranged in a borehole of the sliding mass under an in-situ condition, so as to accurately measure parameters, for example, pore water pressure and moisture content under the in-situ condition, and effectively solve the problems of low efficiency, high cost, poor correlation, etc. of an existing multi-instrument independent distributed type integrated monitoring method. Therefore, based on the idea of "multi-measurement in one hole", an arrangement device is developed for an underground multi-parameter monitoring sensor in an in-situ environment, which has great significance for monitoring underground multi-information parameters.

SUMMARY

In view of this, the embodiments of the present disclosure provide an arrangement device for integrated sensors at a deep position of a sliding mass and a monitoring method for solving the above problems.

The embodiment of the present disclosure provides an arrangement device for integrated sensors at a deep position of a sliding mass, including:

a monitor including a casing pipe and a sensor integrated probe, where the casing pipe extends in a vertical direction and is configured to be lowered into a borehole, and a mounting hole penetrates a side wall of the casing pipe; and the sensor integrated probe includes a push body and a flexible body, the push body being mounted in the mounting hole, a push groove being provided in one side, facing an interior of the casing pipe, of the push body, the flexible body being attached to an inner side wall of the casing pipe, one end of the flexible body being connected to the push body, the other end thereof being located in the casing pipe, and a sensor being mounted on the flexible body; and a monitor arrangement system including an arrangement probe, where the arrangement probe includes a driving mechanism and a propelling portion, the propelling portion being connected to the driving mechanism and configured to be lowered to a position, opposite the push groove, in the borehole, and the driving mechanism driving the propelling portion to move towards the push groove, so as to make the push body and the flexible body penetrate the mounting hole to be pushed into the borehole.

Further, the arrangement probe may further include a hollow extendable box, a through hole penetrating one side of the extendable box; and the driving mechanism may include a driving assembly, the driving assembly including a plurality of driving electric motors arranged at intervals one above another and a bending chain, where the plurality of driving electric motors may be located on an upper side or a lower side of the through hole and mounted on the extendable box, transmission gears may be fixed to driving shafts of the driving electric motors and located in the extendable box, one end of the bending chain may be located in the through hole and fixedly connected to the propelling portion, the other end thereof may mesh with the plurality of transmission gears sequentially, one side, away from the transmission gears, of the bending chain may abut against an inner side wall of the extendable box, the driving electric motors may drive the transmission gears to rotate and drive the bending chain to conduct transmission, so as to move one end, located in the through hole, of the bending chain outwards, and to further push the propelling portion to move towards the push groove.

Further, two arrangement assemblies may be formed by the extendable boxes and the driving assemblies and symmetrically arranged one above the other, the extendable boxes of the two arrangement assemblies may be fixedly connected, one ends, located at the through holes, of the two bending chains may be fixedly connected to the same propelling portion, and the two through holes may be located in middles of the arrangement assemblies.

Further, the arrangement probe may further include a hollow housing, the plurality of arrangement assemblies may be fixed in the housing in a circumferential direction of the housing, and a receding hole may be provided in a position, opposite the through hole, of the housing.

Further, a limiting sheet may be arranged between every two adjacent transmission gears, arranged adjacent to an inner side of the bending chain, and fixed to the inner side wall of the extendable box; and/or, one side, away from the transmission gear, of the bending chain may be connected to a bending limiting sheet, such that the bending chain may only bend towards one side with the transmission gear.

Further, the arrangement device for integrated sensors at a deep position of a sliding mass may further include a monitoring system, where a flat cable groove extending in a vertical direction may penetrate an outer side wall of the casing pipe, a lower end of the flat cable groove may extend to the mounting hole, a main flat cable may be embedded in the flat cable groove, and a flat cable connector may be reserved at a top end of the casing pipe and configured to be connected to the main flat cable and the monitoring system.

Further, a shaft pipe may be mounted in the mounting hole, a winding hub may be fixed to the shaft pipe, one end of the shaft pipe may be fixedly connected to a side wall of the mounting hole, the other end thereof may be spaced from the side wall of the mounting hole, a reserved flat cable may be wound around the winding hub, a threading hole may penetrate the shaft pipe, a lower end of the main flat cable may penetrate into the shaft pipe from the threading hole, penetrate out of the other end of the shaft pipe and be connected to one end of the reserved flat cable, and the other end of the reserved flat cable may be electrically connected to the sensor.

Further, the monitor arrangement system may further include a traction mechanism, the arrangement probe may have a vertical movement stroke, and the traction mechanism may be connected to the arrangement probe so as to pull the arrangement probe to move in the vertical direction.

Further, a Hall sensor may be fixed on the arrangement probe, a positioning magnet matching the Hall sensor may be arranged on the inner side wall of the casing pipe, and when the propelling portion of the arrangement probe is opposite to the push groove, the Hall sensor may be opposite the positioning magnet and detects a maximum magnetic field intensity.

The embodiment of the present disclosure further provides a monitoring method based on the arrangement device for integrated sensors at a deep position of a sliding mass and including the following steps:

S1, surveying a surface of a sliding mass, then determining a monitoring position, constructing a borehole at a preset position, lowering a casing pipe, and using a traction mechanism to lower an arrangement probe into the casing pipe;

S2, using the traction mechanism to lift the arrangement probe upwards, wherein when a Hall sensor in the arrangement probe measures a maximum magnetic field intensity, the Hall sensor and a positioning magnet are located at a same height and a through hole of the arrangement probe is opposite to a mounting hole, and temporarily stopping a winch;

S3, using a driving mechanism to drive a push body to move towards a push groove, so as to make the push body and a flexible body penetrate the mounting hole to be pushed into the borehole;

S4, repeating S2 and S3; and

S5, arranging all the sensor integrated probes, and then connecting a main flat cable to a monitoring system by means of a flat cable connector on the casing pipe.

The technical solution provided by the embodiments of the present disclosure has the beneficial effects that compared with existing related technologies, operation is simpler and an automation degree is higher; and disturbance of a monitoring environment is reduced in a static push-in mode, and moreover, an arrangement range outside the hole is enlarged through an arrangement method with a one-way bending chain, which may be better close to an original underground environment, and accordingly, more accurate underground multi-field information of the landslide may be measured. Power cables and communication cables are integrated outside the side wall of the casing pipe, connected to the plurality of integrated sensors and then connected to a ground monitoring system, thereby having high reliability and being not prone to damage.

Figure 1:
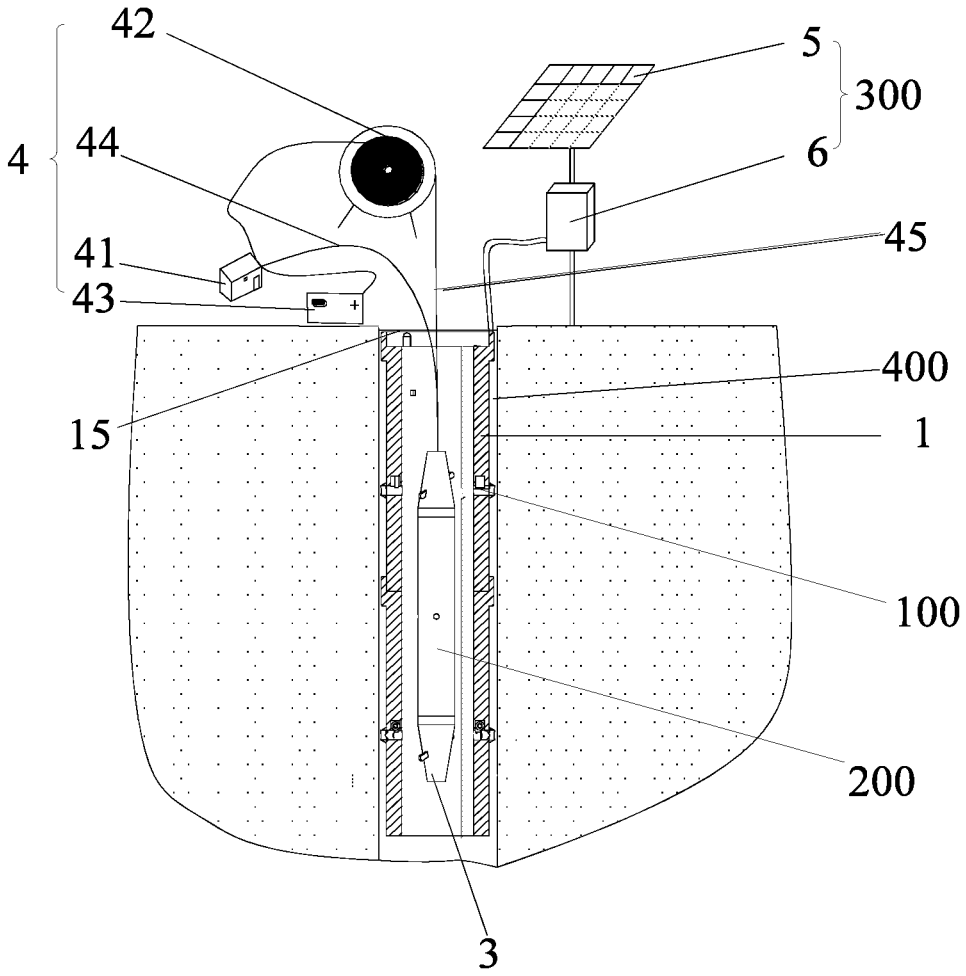
FIG. 1 is a schematic structural diagram of an embodiment of an arrangement device for integrated sensors at a deep position of a sliding mass provided in the present disclosure.
Figure 2:
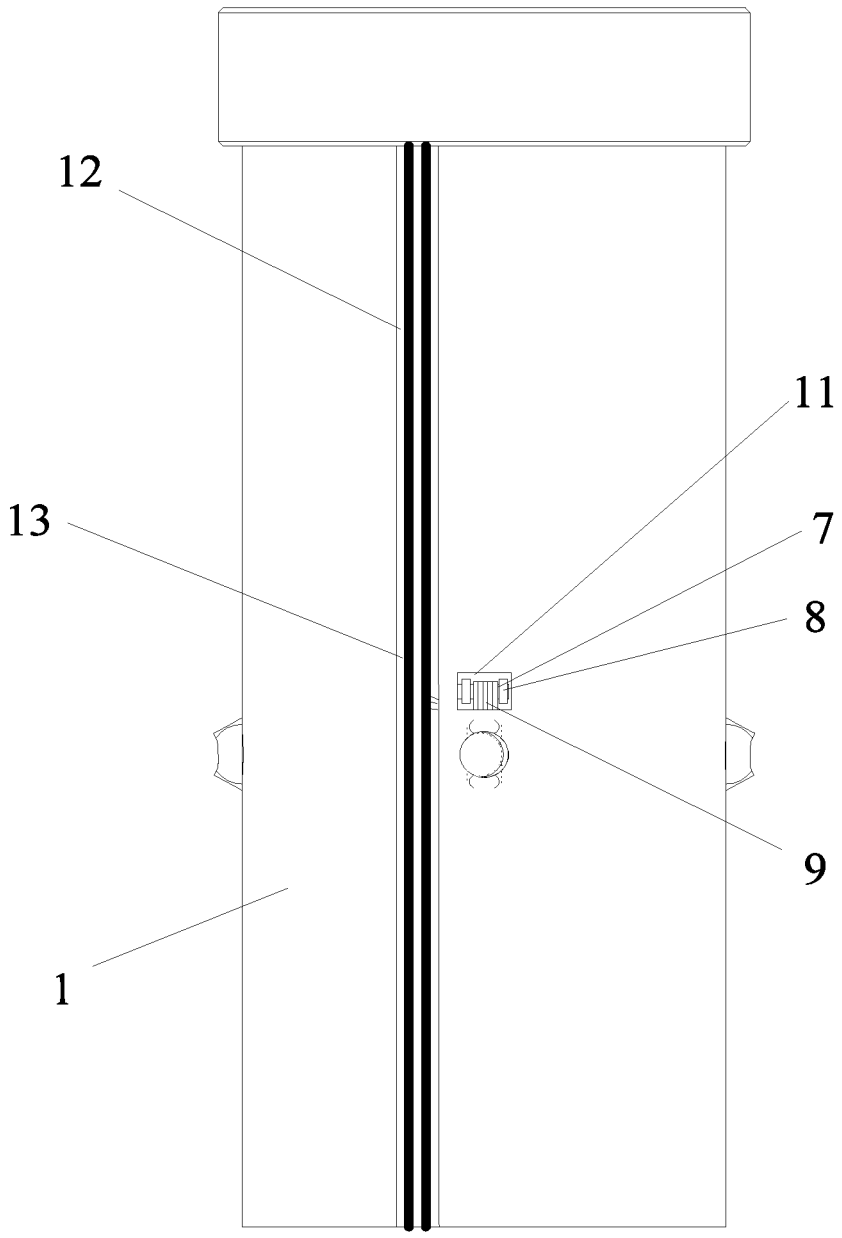
FIG. 2 is a schematic structural diagram of a casing pipe in FIG. 1.
Figure 3:
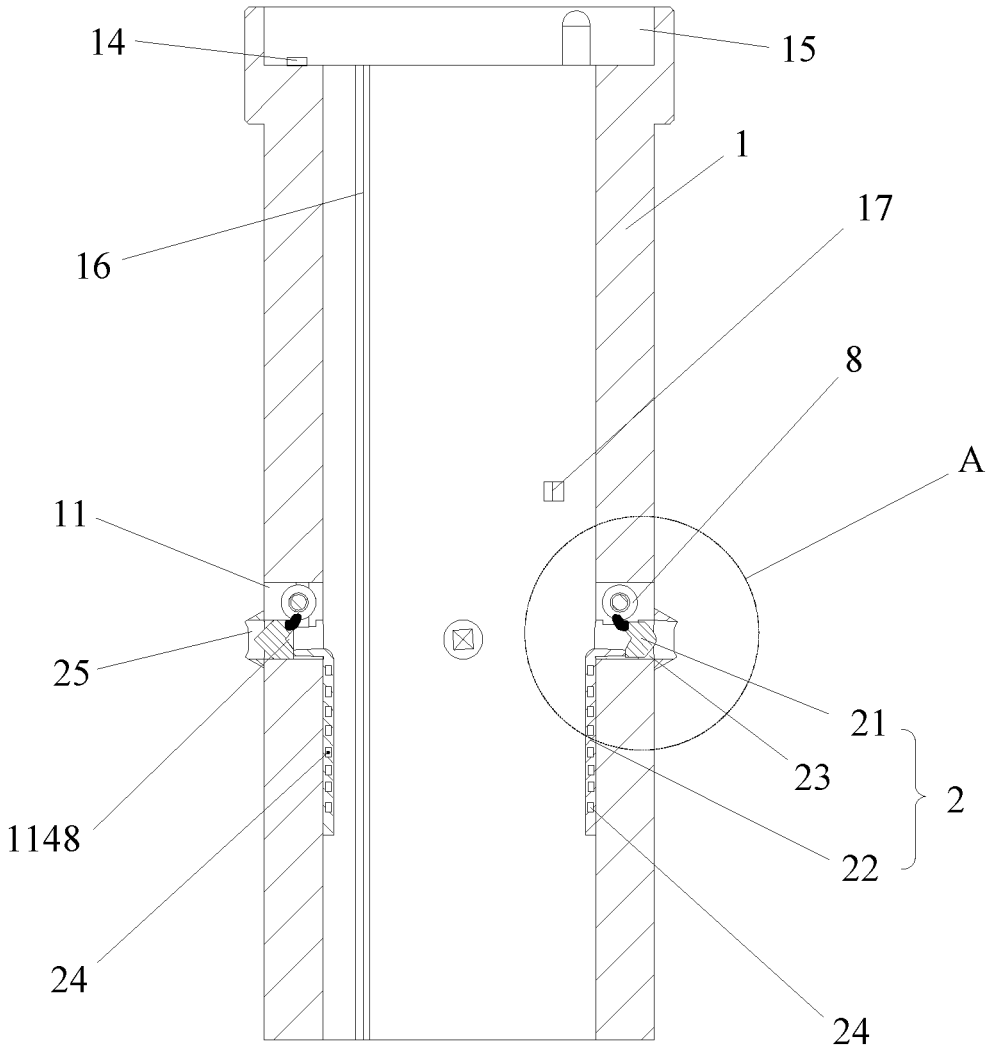
FIG. 3 is a schematic cutaway diagram of the casing pipe in FIG. 2.
Figure 4:
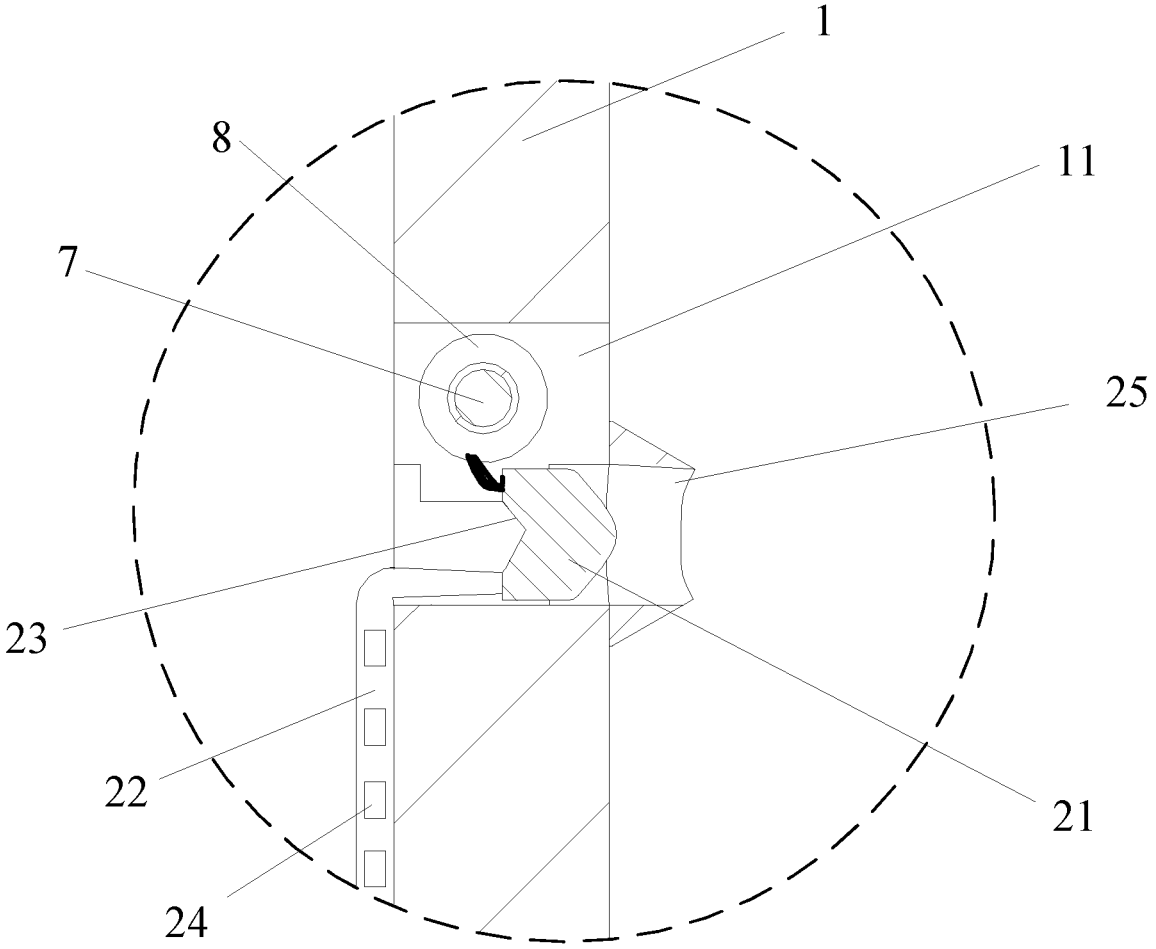
FIG. 4 is an enlarged schematic diagram of A in FIG. 3.
Figure 5:
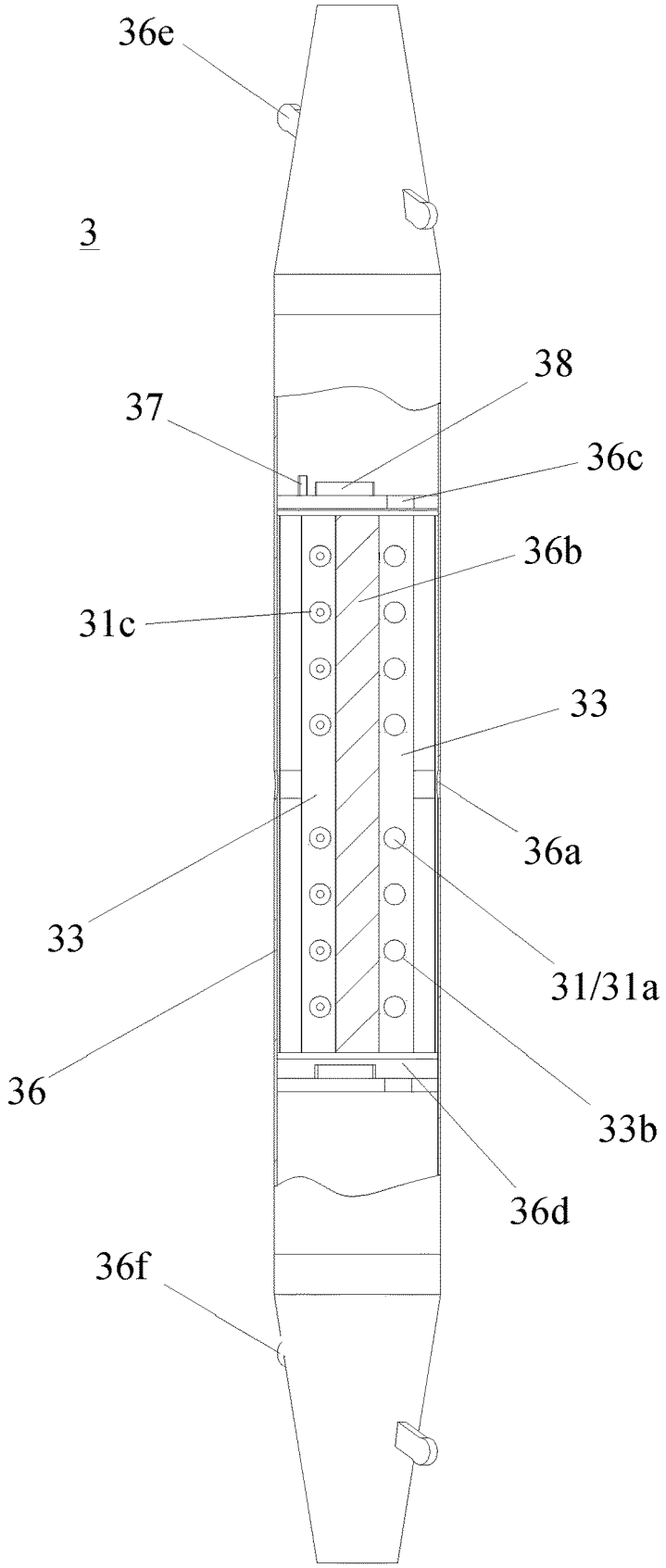
FIG. 5 is a schematic cutaway diagram of an arrangement probe in FIG. 1.
Figure 6:
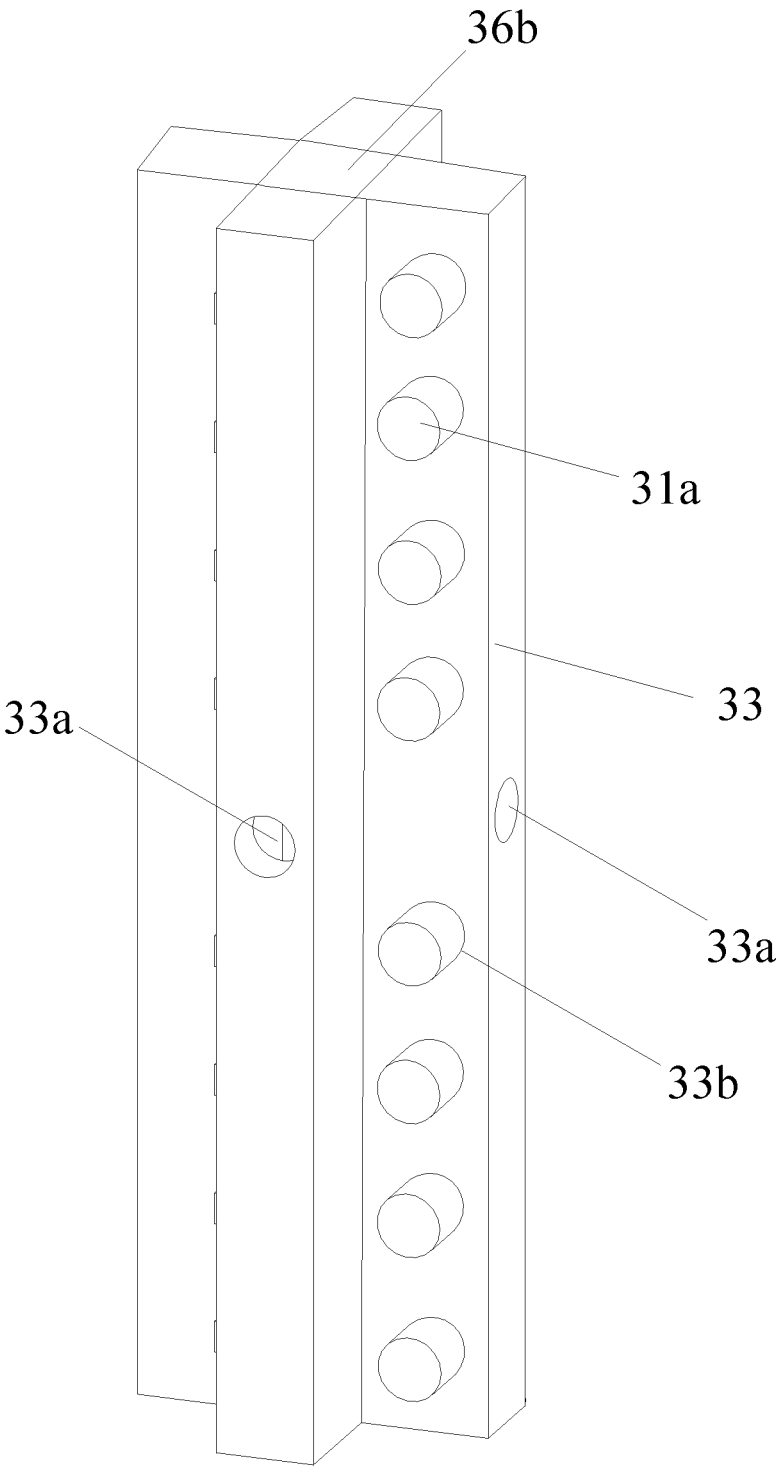
FIG. 6 is a schematic structural diagram of an arrangement assembly in FIG. 5.
Figure 7:
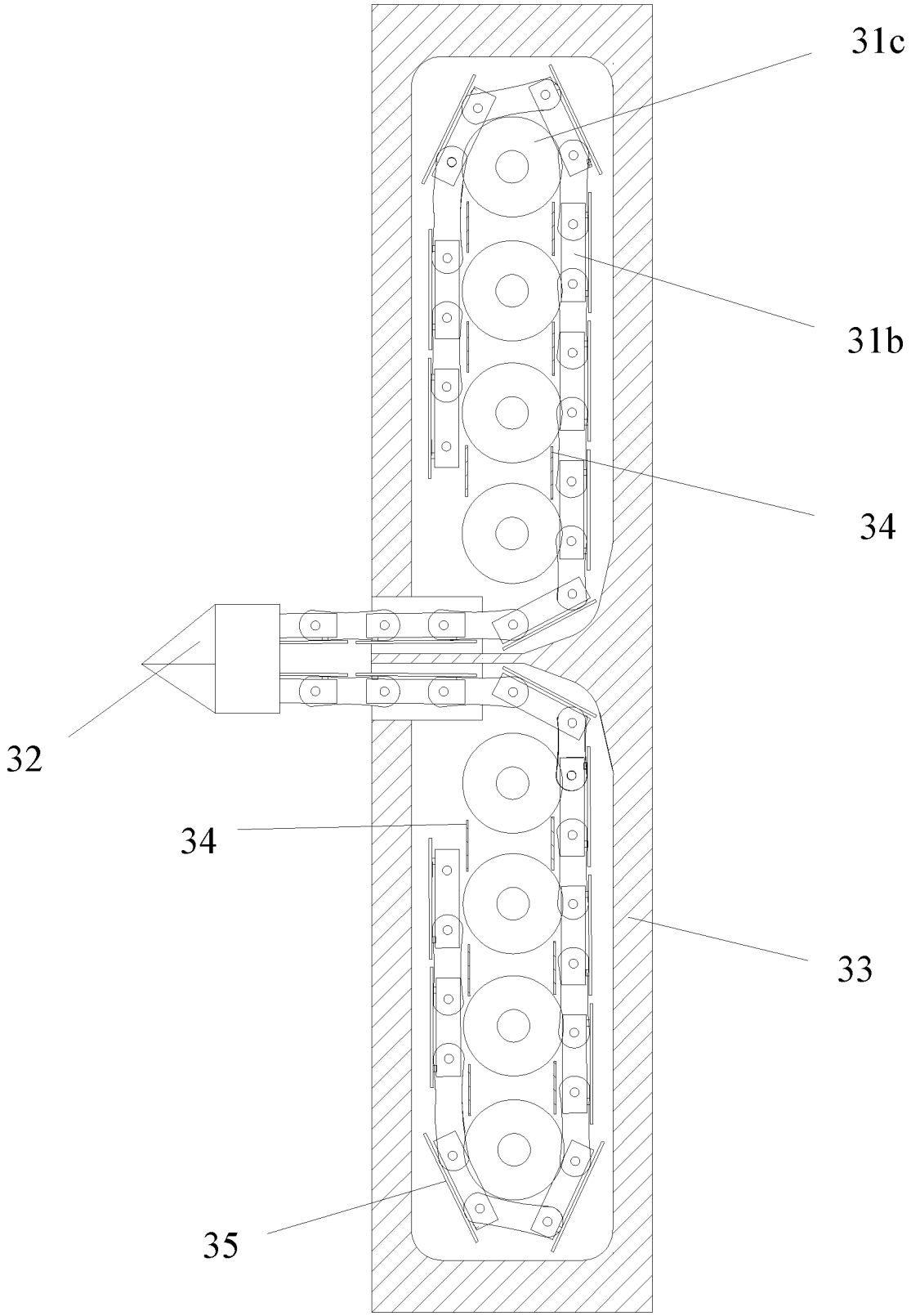
FIG. 7 is a schematic cutaway diagram of the arrangement assembly in FIG. 6.
Figure 8:
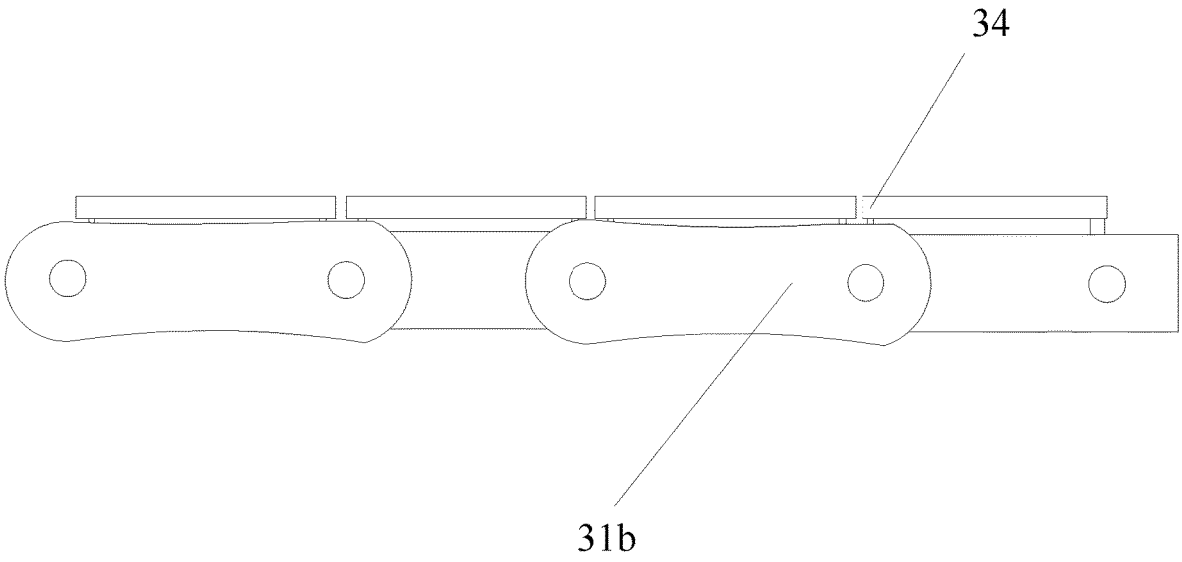
FIG. 8 is a schematic diagram of a partial structure of a bending chain in FIG. 7.

In the figures: monitor 100, monitor arrangement system 200, monitoring system 300, borehole 400, casing pipe 1, mounting hole 11, flat cable groove 12, main flat cable 13, flat cable connector 14, seal cover 15, guide groove 16, positioning magnet 17, sensor integrated probe 2, push body 21, flexible body 22, push groove 23, sensor 24, bump 25, arrangement probe 3, driving mechanism 31, driving electric motor 31*a*, bending chain 31*b*, transmission gear 31*c*, propelling portion 32, extendable box 33, through hole 33*a*, fixing hole 33*b*, limiting sheet 34, bending limiting sheet 35, housing 36, receding hole 36*a*, fixing column 36*b*, upper partition plate 36*c*, lower partition plate 36*d*, upper slide wheel device 36*e*, lower slide wheel device 36*f*, Hall sensor 37, integrated circuit board 38, traction mechanism 4, control module 41, winch 42, arrangement power supply 43, integrated cable 44, rope 45, power supplying assembly 5, control/communication module 6, shaft pipe 7, winding hub 8, and reserved flat cable 9.

DETAILED DESCRIPTION OF THE EMBODIMENTS

In order to make the objectives, technical solutions and advantages of the present disclosure clearer, the implementations of the present disclosure are described in more detail below with reference to the accompanying drawings.

With reference to FIGS. 1-8, the embodiments of the present disclosure provides an arrangement device for integrated sensors 24 at a deep position of a sliding mass, including a monitor 100, a monitor arrangement system 200 and a monitoring system 300.

The monitor 100 includes a casing pipe 1 and a sensor integrated probe 2, where the casing pipe 1 extends in a vertical direction and is used for matching an engineering auxiliary apparatus to be lowered into a borehole 400 to protect a monitoring environment in the borehole 400. When a depth of the borehole 400 is larger than a length of a single casing pipe 1, a plurality of casing pipes 1 may be combined and connected to lower the casing pipes 1. A plurality of mounting holes 11 penetrate a side wall of the casing pipe 1 one above another, and a plurality of rows of mounting holes 11 are provided in the casing pipe 1 in a circumferential direction. A flat cable groove 12 extending in a vertical direction may penetrate an outer side wall of the casing pipe 1, a lower end of the flat cable groove 12 may extend to the mounting hole 11, a main flat cable 13 may be embedded in the flat cable groove 12, and a flat cable connector 14 may be reserved at a top end of the casing pipe 1 and configured to be connected to the main flat cable 13 and the monitoring system 300.

An upper end of the casing pipe 1 is detachably covered with a seal cover 15, and the seal cover 15 may be a metal or cement cover plate, which may prevent foreign matter from falling into the casing pipe 1, so as to prevent a monitoring environment in the casing pipe 1 from being damaged.

The plurality of sensor integrated probes 2 are arranged and are in one-to-one correspondence with the mounting holes 11. The sensor integrated probe 2 includes a push body 21 and a flexible body 22, the push body 21 being mounted in the mounting hole 11, a push groove 23 being provided in one side, facing an interior of the casing pipe 1, of the push body 21, the flexible body 22 being attached to an inner side wall of the casing pipe 1, one end of the flexible body being connected to the push body 21, the other end thereof being located in the casing pipe 1, and a sensor 24 being mounted on the flexible body 22. The sensor integrated probes 2 are distributed along the casing pipe 1 at equal intervals of 0.5 m from bottom to top, and generally four sensor integrated probes are distributed along a periphery of the casing pipe.

The monitor arrangement system 200 may include an arrangement probe 3 and a traction mechanism 4, the arrangement probe 3 may have a vertical movement stroke, and the traction mechanism 4 may be connected to the arrangement probe 3 so as to pull the arrangement probe 3 to move in the vertical direction.

The traction mechanism 4 includes a control module 41, a winch 42, an arrangement power supply 43, an integrated cable 44 and a rope 45. The control module 41 is electrically connected to the winch 42, connected to the arrangement probe 3 by means of the integrated cable 44 and mainly used for controlling the devices to work, and the integrated cable 44 is mainly a cable and may control arrangement action of the arrangement probe 3. The winch 42 is connected to the arrangement probe 3 by means of the rope 45 and used for lowering the arrangement probe 3 to a bottom of the casing pipe 1 and controlling the arrangement probe 3 to move from the bottom to the top of the casing pipe 1. The arrangement power supply 43 is electrically connected to the control module 41, the winch 42 and the arrangement probe 3, and provides electric power for the traction mechanism 4 and the arrangement probe 3 of the monitor arrangement system 200.

The arrangement probe 3 includes a driving mechanism 31 and a propelling portion 32, the propelling portion 32 being connected to the driving mechanism 31 and configured to be lowered to a position, opposite the push groove 23, in the borehole 400, and the driving mechanism 31 driving the propelling portion 32 to move towards the push groove 23, so as to make the push body 21 and the flexible body 22 penetrate the mounting hole 11 to be pushed into the borehole 400. Specifically, the push body 21 is of a conical shape, the push groove 23 is of a rectangular pyramid shape, the propelling portion 32 matches the push groove 23 and is of a rectangular pyramid shape, and the propelling portion 32 may be prevented from rotating in the pushing process.

In a process that the propelling portion 32 pushes the push body 21 into the borehole 400, the flexible body 22 is always attached to the inner side wall of the casing pipe 1. In other embodiments, the flexible body 22 may extend in any direction, a guiding groove is fixed to the inner side wall of the casing pipe 1, the flexible body 22 is located in the guiding groove, and accordingly, and the flexible body 22 may be prevented from falling off and colliding with the propelling portion 32. In this embodiment, the flexible body 22 extends in the vertical direction under the action of gravity, an upper end thereof is connected to the push body 21 and located below the push groove 23, the propelling portion 32 may not interfere with the flexible body 22 in the pushing process, and mounting is easy and convenient.

In order to guarantee the mounting firmness of the sensor integrated probe 2, a bump 25 is fixed to one end, away from the flexible body 22, of the push body 21, an end of the bump 25 interferes with a side wall of the mounting hole 11 so as to limit the bump 25 to an outer side of the casing pipe 1, and the flexible body 22 is bonded to the inner side wall of the casing pipe 1, which may guarantee that the sensor integrated probe 2 is firmly mounted on the casing pipe 1. The propelling portion 32 pushes the push body 21, such that the flexible body 22 may fall off from the inner side wall of the casing pipe 1. In this embodiment, the flexible body 22 is a corrugated pipe, an upper end of the corrugated pipe is in hinged flexible connection to the push body 21, a plurality of arrangement windows for the sensors 24 are provided in the corrugated pipe, various sensors 24 are mounted in the corrugated pipe, subjected to circuit waterproof treatment and used for monitoring a sliding mass environment outside a hole, and the corrugated pipe may protect the sensors 24. Further, the corrugated pipe has a crescent-shaped section, and the propelling portion 32 and the corrugated pipe do not press against each other.

The monitoring system 300 includes a solar power supplying assembly 5 and a control/communication module 6, where the solar power supplying assembly 5 is electrically connected to the driving electric motor 31*a*, the sensor 24, the integrated circuit board 38 and the control/communication module 6 to provide power for the entire monitoring system 300. The control/communication module 6 is electrically connected to the sensor 24 and the integrated circuit board 38 by means of flat cables and used for processing monitoring data, and may be in communication connection with the outside, for example, upload monitoring information to the Internet.

In a pushed process of the push body 21, the sensor 24 on the flexible body 22 moves accordingly, the sensor 24 is connected to the monitoring system 300 by means of the main flat cable 13. In order to connect the main flat cable 13 to the sensor 24 all the time, the main flat cable 13 may be arranged in the flat cable groove 12 in a bendable mode, and the main flat cable 13 in the flat cable groove 12 may be straightened along with the movement of the sensor 24, so as to guarantee electrical connection between the sensor 24 and the integrated circuit board 38. In this embodiment, a shaft pipe 7 may be mounted in the mounting hole 11, a winding hub 8 may be fixed to the shaft pipe 7, one end of the shaft pipe 7 may be fixedly connected to a side wall of the mounting hole 11, the other end thereof may be spaced from the side wall of the mounting hole 11, a reserved flat cable 9 may be wound around the winding hub 8, a threading hole may penetrate the shaft pipe 7, a lower end of the main flat cable 13 may penetrate into the shaft pipe 7 from the threading hole, penetrate out of the other end of the shaft pipe 7 and be connected to one end of the reserved flat cable 9, and the other end of the reserved flat cable 9 may be electrically connected to the sensor 24. In this way, the sensor 24 moves to pull the reserved flat cable 9 so as to drive the winding hub 8 to rotate, the main flat cable 13 is twisted, and the winding hub 8 rotates to release the reserved flat cable 9, which guarantees the electrical connection between the sensor 24 and the integrated circuit board 38. The winding hub 8 and the push body 21 may be mounted in different mounting holes.

The arrangement probe 3 may further include a hollow extendable box 33, a through hole 33*a* penetrating one side of the extendable box 33. The driving mechanism 31 may include a driving assembly, the driving assembly including a plurality of driving electric motors 31*a* arranged at intervals one above another and a bending chain 31*b*, where the plurality of driving electric motors 31*a* may be located on an upper side or a lower side of the through hole 33*a* and mounted on the extendable box 33, transmission gears 31*c* may be fixed to driving shafts of the driving electric motors 31*a* and located in the extendable box 33, one end of the bending chain 31*b* may be located in the through hole 33*a* and fixedly connected to the propelling portion 32, the other end thereof may mesh with the plurality of transmission gears 31*c* sequentially, and one side, away from the transmission gears 31*c*, of the bending chain 31*b* may abut against an inner side wall of the extendable box 33, which avoids tilting of the bending chain 31*b*, and guarantees meshing between the bending chain 31*b* and the transmission gears 31*c*.

The driving electric motor 31*a* is a stepping electric motor. The driving electric motor 31*a* drives the transmission gears 31*c* to rotate and drive the bending chain 31*b* to conduct transmission, so as to move one end, located in the through hole 33*a*, of the bending chain 31*b* outwards, and to further push the propelling portion 32 to move towards the push groove 23. The driving electric motor 31*a* may be fixed in the extendable box 33. In this embodiment, a fixing hole 33*b* penetrates a side wall of the extendable box 33, the driving electric motor 31*a* is fixed in the fixing hole 33*b*, and the driving shaft of the driving electric motor 31*a* is perpendicular to an extending direction of the through hole 33*a*.

A limiting sheet 34 may be arranged between every two adjacent transmission gears 31*c*, arranged adjacent to an inner side of the bending chain 31*b*, and fixed to the inner side wall of the extendable box 33, which may prevent a tail of the bending chain 31*b* from being clamped into a gap between the transmission gears 31*c* when the transmission gears 31*c* rotate and retract the bending chain 31*b*. One side, away from the transmission gear 31*c*, of the bending chain 31*b* is connected to a bending limiting sheet 35, such that the bending chain 31*b* may only bend towards one side with the transmission gear 31*c*, which guarantees transmission connection between the bending chain 31*b* and the transmission gear 31*c*.

Two arrangement assemblies may be formed by the extendable boxes 33 and the driving assemblies and symmetrically arranged one above the other. The extendable boxes 33 of the two arrangement assemblies may be fixedly connected. One ends, located at the through holes 33*a*, of the two bending chains 31*b* may be fixedly connected to the same propelling portion 32, and the two through holes 33*a* may be located in middles of the arrangement assemblies, which guarantees that the propelling portion 32 may be opposite the mounting hole 11. The two bending chains 31*b* are connected by means of the propelling portion 32, stable pushing of the ends of the two chains may be guaranteed, and the two sets of transmission gears 31*c* rotate in opposite directions to eject and retract the bending chains 31*b*. Moreover, the two bending chains 31*b* apply pushing force to the propelling portion 32, such that the propelling portion 32 may be pushed into a side wall of the borehole 400. The number of transmission gears 31*c* and stepping electric motors and a length of the bending chain 31*b* are increased by increasing a height of the extendable box 33, thereby increasing an extension range, and then arranging the plurality of sensors 24 in a farther range outside the borehole 400.

The arrangement probe 3 further includes a hollow housing 36, and an upper slide wheel device 36*e* and a lower slide wheel device 36*f* are mounted at an upper end and a lower end of the housing 36 respectively. A guide groove 16 extending in the vertical direction is provided in the inner side of the casing pipe 1, an upper end of the guide groove 16 penetrates the casing pipe 1, and the upper slide wheel device 36*e* and the lower slide wheel device 36*f* are located in the guide groove 16. In this embodiment, the plurality of guide grooves 16 are evenly provided in the circumferential direction of the casing pipe 1 at intervals and guide up-and-down movement of the arrangement probe 3.

The plurality of arrangement assemblies may be fixed in the housing 36 in a circumferential direction of the housing 36, and a receding hole 36*a* may be provided in a position, opposite the through hole 33*a*, of the housing 36. A fixing column 36*b* is fixed to a middle of the housing 36, one sides, away from the through hole 33*a*, of the arrangement assemblies are connected to the fixing column 36*b*, and the plurality of arrangement assemblies are evenly arranged in a circumferential direction of the fixing column 36*b* at intervals. In this embodiment, four arrangement assemblies are provided, the four arrangement assemblies and the fixing column 36*b* are arranged in a cross shape on the section, and the sensors 24 may be arranged on the borehole 400 in multiple directions simultaneously. In this embodiment, an upper partition plate 36*c* and a lower partition plate 36*d* are fixed in the housing 36 at intervals one above the other, and upper ends and lower ends of the fixing column 36*b* and the arrangement assemblies are fixedly connected to the upper partition plate 36*c* and the lower partition plate 36*d* respectively.

A Hall sensor 37 and an integrated circuit board 38 are fixed on the arrangement probe 3, specifically, the Hall sensor 37 and the integrated circuit board 38 are fixed on the upper partition plate 36*c*, and the integrated circuit board 38 is electrically connected to the Hall sensor 37 and the driving electric motor 31*a* and used for controlling operation of the driving electric motor 31*a* and is subjected to waterproof protection.

Positioning magnets 17 matching the Hall sensors 37 are arranged on the inner side wall of the casing pipe 1, and each positioning magnet 17 is arranged corresponding to a plurality of mounting holes 11 located at an equal height. When the propelling portion 32 and the through hole 33*a* of the arrangement probe 3 are opposite the mounting hole 11, the Hall sensor 37 is opposite to the positioning magnet 17, and the Hall sensors 37 detects a maximum magnetic field intensity, which is used for positioning the arrangement probe 3. The Hall sensor 37 is configured to match the positioning magnet to determine an underground position of the arrangement probe 3.

Figure 9:
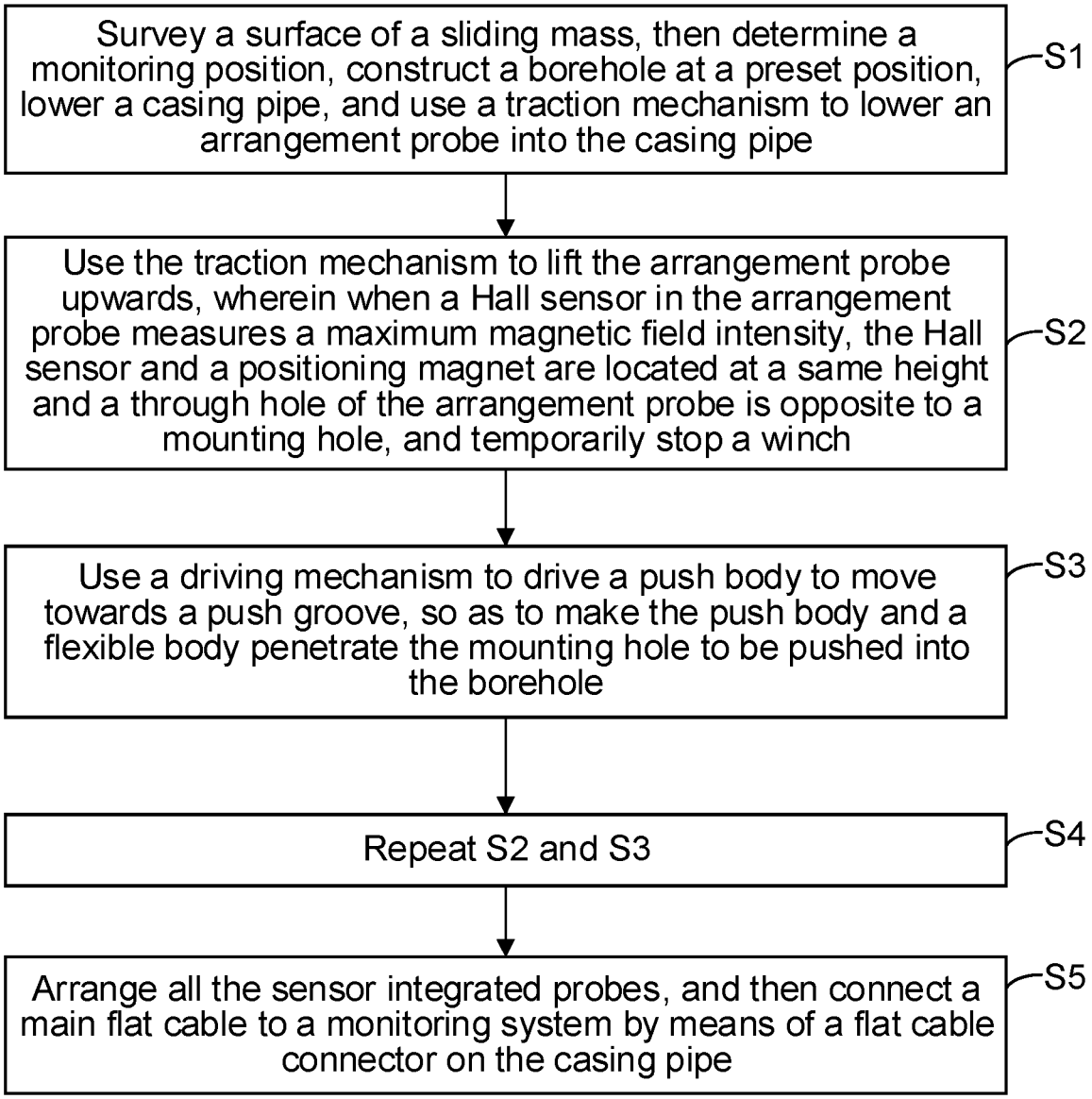
FIG. 9 is a schematic diagram of a flowchart of an embodiment of a monitoring method provided in the present disclosure.

With reference to FIG. 9, based on the arrangement device for integrated sensors at a deep position of a sliding mass, the embodiment of the present disclosure further provides a monitoring method. The monitoring method includes the following steps:

S1, a surface of a sliding mass is surveyed, then a monitoring position is determined, a borehole 400 is constructed at a preset position, and a casing pipe 1 is lowered. A traction mechanism 4 is used to lower an arrangement probe 3 into the casing pipe 1. Specifically, the traction mechanism 4 is erected and then connected to an arrangement power supply 43, and a control module 41 controls a winch 42 to lower the arrangement probe 3 into the casing pipe 1 by means of a rope 45.

S2, the traction mechanism 4 is used to lift the arrangement probe 3 upwards, the control module 41 controls the winch 42 to lift the arrangement probe 3 upwards by means of the rope 45, when a Hall sensor 37 in the arrangement probe 3 measures a maximum magnetic field intensity, the Hall sensor 37 and a positioning magnet are located at a same height and a through hole 33*a* of the arrangement probe 3 is opposite to a mounting hole 11, and the winch 42 stops temporarily.

S3, a driving mechanism 31 is used to drive a push body to move towards a push groove 23, so as to make the push body 21 and a flexible body 22 penetrate the mounting hole 11 to be pushed into the borehole 400. Specifically, the control module 41 controls, by means of an integrated circuit board 38, a stepping electric motor in the arrangement probe 3 to work, and the stepping electric motor is powered on to rotate to drive a transmission gear 31*c* to rotate, such that a bending chain 31*b* penetrates out of the through hole 33*a* and is sent out of the extendable box 33. Since the bending limiting sheet 35 allows the bending chains 31*b* to be bent only to one side, tops of the two bending chains 31*b* are fixed in the push grooves 23 by means of the propelling portions 32 to be collaboratively pushed into side walls of the boreholes 400. The flexible body 22 and various integrated sensors 24 provided thereon are sent into a sliding mass environment outside the hole for monitoring. In the pushing process, the winding hub 8 rotates to connect the reserved flat cable 9 to the various integrated sensors 24 all the time.

S4, S2 and S3 are repeated.

S5, all the sensor integrated probes 2 are arranged, then a seal cover 15 covers an upper end of the casing pipe 1, and then a main flat cable 13 is connected to a monitoring system 300 by means of a flat cable connector 14 on the casing pipe 1.

Compared with existing related technologies, the technical solution provided in the present disclosure has the beneficial effects that operation is simpler and an automation degree is higher; and disturbance of a monitoring environment is reduced in a static push-in mode, and moreover, an arrangement range outside the hole is enlarged by means of a one-way bending chain 31*b* type arrangement method, which may be better close to an original underground environment, and accordingly, more accurate underground multi-field information of the landslide may be measured. Power cables and communication cables are integrated outside the side wall of the casing pipe 1, connected to the plurality of integrated sensors 24 and then connected to a ground monitoring system 300, thereby having high reliability and being not prone to damage.

Herein, the involved terms including front, rear, upper, lower, etc., are defined in terms of the positions of parts and between the parts in the drawings, just for clarity and convenience of expressing the technical scheme. It should be understood that the use of such parties should not limit the scope of protection of the claimed application.

The embodiments in the present disclosure and the features in the embodiments may be combined with each other in a non-conflicting situation.

The above-mentioned are merely preferred embodiments of the present disclosure, and are not intended to limit the present disclosure. Any modifications, equivalent replacements and improvements made within the spirit and principle of the present disclosure should fall within the protection scope of the present disclosure.

What is claimed is:

1. An arrangement device for integrated sensors at a deep position of a sliding mass, comprising:

a monitor comprising a casing pipe and a sensor integrated probe, wherein the casing pipe extends in a vertical direction and is configured to be lowered into a borehole, and a mounting hole penetrates a side wall of the casing pipe; and the sensor integrated probe comprises a push body and a flexible body, the push body being mounted in the mounting hole, a push groove being provided in one side, facing an interior of the casing pipe, of the push body, the flexible body being attached to an inner side wall of the casing pipe, one end of the flexible body being connected to the push body, the other end thereof being located in the casing pipe, and a sensor being mounted on the flexible body; and a monitor arrangement system comprising an arrangement probe, wherein the arrangement probe comprises a driving mechanism and a propelling portion, the propelling portion being connected to the driving mechanism and configured to be lowered to a position, opposite the push groove, in the borehole, and the driving mechanism driving the propelling portion to move towards the push groove, so as to make the push body and the flexible body penetrate the mounting hole to be pushed into the borehole;

the arrangement probe further comprises a hollow extendable box, a through hole penetrating one side of the extendable box; and the driving mechanism comprises a driving assembly, the driving assembly comprising a plurality of driving electric motors arranged at intervals one above another and a bending chain, wherein the plurality of driving electric motors are located on an upper side or a lower side of the through hole and mounted on the extendable box, transmission gears are fixed to driving shafts of the driving electric motors and located in the extendable box, one end of the bending chain is located in the through hole and fixedly connected to the propelling portion, the other end thereof meshes with the plurality of transmission gears sequentially, one side, away from the transmission gears, of the bending chain abuts against an inner side wall of the extendable box, the driving electric motors drive the transmission gears to rotate and drive the bending chain to conduct transmission, so as to move one end, located in the through hole, of the bending chain outwards, and to further push the propelling portion to move towards the push groove.

2. The arrangement device according to claim 1, wherein two arrangement assemblies are provided each is formed by the extendable box and the driving assembly and are symmetrically arranged one above the other, extendable boxes of the two arrangement assemblies are fixedly connected, one ends, located at the through holes, of two bending chains are fixedly connected to the same propelling portion, and two through holes are located in middles of the arrangement assemblies.

3. The arrangement device according to claim 2, wherein the arrangement probe further comprises a hollow housing, a plurality of arrangement assemblies are fixed in the housing in a circumferential direction of the housing, and a receding hole is provided in a position, opposite the through hole, of the housing.

4. The arrangement device according to claim 1, wherein a limiting sheet is arranged between every two adjacent transmission gears, arranged adjacent to an inner side of the bending chain, and fixed to the inner side wall of the extendable box; and/or, one side, away from the transmission gear, of the bending chain is connected to a bending limiting sheet, such that the bending chain may only bend towards one side with the transmission gears.

5. The arrangement device according to claim 1, further comprising a monitoring system, wherein a flat cable groove extending in a vertical direction penetrates an outer side wall of the casing pipe, a lower end of the flat cable groove extends to the mounting hole, a main flat cable is embedded in the flat cable groove, and a flat cable connector is reserved at a top end of the casing pipe and configured to be connected to the main flat cable and the monitoring system.

6. The arrangement device according to claim 5, wherein a shaft pipe is mounted in the mounting hole, a winding hub is fixed to the shaft pipe, one end of the shaft pipe is fixedly connected to a side wall of the mounting hole, the other end thereof is spaced from the side wall of the mounting hole, a reserved flat cable is wound around the winding hub, a threading hole penetrates the shaft pipe, a lower end of the main flat cable penetrates into the shaft pipe from the threading hole, penetrates out of the other end of the shaft pipe and is connected to one end of the reserved flat cable, and the other end of the reserved flat cable is electrically connected to the sensor.

7. The arrangement device according to claim 1, wherein the monitor arrangement system further comprises a traction mechanism, the arrangement probe has a vertical movement stroke, and the traction mechanism is connected to the arrangement probe so as to pull the arrangement probe to move in the vertical direction.

8. The arrangement device according to claim 7, wherein a Hall sensor is fixed on the arrangement probe, a positioning magnet matching the Hall sensor is arranged on the inner side wall of the casing pipe, and when the propelling portion of the arrangement probe is opposite to the push groove, the Hall sensor is opposite to the positioning magnet and detects a maximum magnetic field intensity.

9. A monitoring method, using the arrangement device according to claim 8 and comprising the following steps:

S1, surveying a surface of the sliding mass, then determining a monitoring position, constructing the borehole at a preset position, lowering the casing pipe, and using the traction mechanism to lower the arrangement probe into the casing pipe;

S2, using the traction mechanism to lift the arrangement probe upwards, wherein when the Hall sensor in the arrangement probe measures the maximum magnetic field intensity, the Hall sensor and the positioning magnet are located at a same height and the through hole of the arrangement probe is opposite to the mounting hole, and temporarily stopping a winch;

S3, using the driving mechanism to drive the push body to move towards the push groove, so as to make the push body and the flexible body penetrate the mounting hole to be pushed into the borehole;

S4, repeating S2 and S3; and

S5, arranging all the sensor integrated probes, and then connecting a main flat cable to a monitoring system by a flat cable connector on the casing pipe.

* * * * *